United States Patent [19]

Giggins, Jr. et al.

[11] 4,086,391

[45] Apr. 25, 1978

[54] ALUMINA FORMING COATINGS CONTAINING HAFNIUM FOR HIGH TEMPERATURE APPLICATIONS

[75] Inventors: Charles Stanley Giggins, Jr., Simsbury; Bernard Henry Kear, Madison, both of Conn.

[73] Assignee: United Technologies Corporation, Hartford, Conn.

[21] Appl. No.: 719,874

[22] Filed: Sep. 1, 1976

Related U.S. Application Data

[62] Division of Ser. No. 589,654, Jun. 23, 1975, Pat. No. 3,993,454.

[51] Int. Cl.[2] ..... B32B 15/18

[52] U.S. Cl. ..... 428/679; 428/628; 428/668; 427/34; 427/250

[58] Field of Search ..... 29/194, 196.5; 75/124, 75/170, 171, .5 R, .5 BB; 427/252, 253, 34, 192, 250; 428/926, 680, 678, 679, 632, 668, 628

[56] References Cited

U.S. PATENT DOCUMENTS

| | | | |
|---|---|---|---|
| 3,528,861 | 9/1970 | Elam et al. | 148/11.5 F |
| 3,914,507 | 10/1975 | Fastukian | 75/.5 BB |
| 3,918,139 | 11/1975 | Felten | 75/171 |
| 3,951,642 | 4/1976 | Chang et al. | 75/.5 BB |
| 3,961,098 | 6/1976 | Bessen | 29/196.1 |
| 3,976,436 | 8/1976 | Chang | 75/124 |

*Primary Examiner*—Arthur J. Steiner
*Attorney, Agent, or Firm*—Charles E. Sohl

[57] ABSTRACT

Coatings are described which are particularly suited for the protection of nickel and cobalt superalloy articles at elevated temperatures. The protective nature of the coatings is due to the formation of an alumina layer on the surface of the coating which serves to reduce oxidation/corrosion. The coatings contain aluminum, chromium, and one metal chosen from the group consisting of nickel and cobalt or mixtures thereof. The coatings further contain a small controlled percentage of hafnium which serves to greatly improve the adherence and durability of the protective alumina film on the surface of the coating.

3 Claims, 5 Drawing Figures

1000X

ALUMINA FORMING COATINGS CONTAINING HAFNIUM FOR HIGH TEMPERATURE APPLICATIONS

This is a division of application Ser. No. 589,654 filed June 23, 1975, now U.S. Pat. No. 3,993,454.

BACKGROUND OF THE INVENTION

1. Field of the Invention

This invention relates to the field of protective coatings for use on nickel and cobalt base alloys, particularly at high temperatures, to reduce oxidation corrosion.

2. Description of the Prior Art

Nickel and cobalt base superalloys are widely used under conditions of high temperature where oxidation/-corrosion are serious problems. Such alloys find particular use in the field of gas turbine engines, where increased efficiency can be obtained by operation at higher temperatures. Under such increased temperatures oxidation/corrosion becomes a greater problem and for this reason current gas turbine engine practice is to use protective coatings on a majority of nickel and cobalt alloy parts which are used at elevated temperatures. The term "oxidation/corrosion" is meant to refer to high temperature interactions between the superalloy or coated superalloy and the environment. The major active element is oxygen, however corrosive effects can result from other elements such as sodium, sulfur and vanadium. The most successful known type of coatings are those which rely on the formation of a continuous layer comprised predominately of aluminum oxide ($Al_2O_3$) on the surface of the coating which acts as a diffusion barrier to minimize further reactions. Alumina has been found to be the most effective protective material with regard to oxygen and is also beneficial with regard to most of the other reactive environmental elements. The function of protective coatings is to form a barrier which minimizes the reaction of the environment with the superalloy base material. A major problem encountered with such coatings is that the coefficient of thermal expansion of the alumina layer differs from the coefficient of expansion of the base material and the coating material which are generally similar. During thermal cycling stresses develop between the alumina layer and the coating material. The alumina layer, which is relatively brittle, tends to crack and spall off thus exposing a fresh surface to the deleterious atmosphere. This repeated formation and spallation of the oxide layer causes the reduction of the coating material in aluminum content. When the aluminum level of the coating material drops below a certain point the coating becomes ineffective as an alumina former and the protective benefits of the coating material are lost.

It has been found in the past that the addition of yttrium to the coating material improves the adherence of the alumina layer to the surface of the coating material. Alumina forming coating materials containing yttrium are described in U.S. Pat. Nos. 3,528,861, 3,542,530 3,649,225 and 3,676,085 all of which are assigned to the assignee of the present invention.

Several prior art patents contain reference to the possible use of hafnium in coatings. U.S. Pat. No. 3,025,182 is directed to coatings which are applied by flame spraying and discloses a process in which a mixture of powders of different compositions are flame sprayed onto the surface to be protected. Hafnium is mentioned in passing as a possible component of one of the powders. If the hafnium were to be present it would be present in boride form with the coating composition as applied containing at least 2 percent boron. The emphasis of the patent is on the use of boron as a reducing agent to eliminate the oxide film formed during flame spraying so that the powder particles which are flame sprayed may bond together adequately. U.S. Pat. Nos. 3,535,146 and 3,620,809 disclose a coating process which involves surface alloying of a wide variety of elements onto the surface to be protected. The essence of the invention is the use of a barrier layer between the surface and the coating layer to retard the diffusion of the coating layer into the substrate thereby prolonging the effectiveness of the coating layer. Hafnium is disclosed as one of a wide variety of elements which may be surface alloyed as a protective coating. Neither aluminum, chromium, nor hafnium are required in the processes disclosed in these patents, thus they do not rely on alumina as a protective layer. U.S. Pat. No. 3,547,681 discloses a multilayer coating for use with tantalum substrates. The coating comprises a porous undercoat and an overcoat which is bonded to the undercoat. Hafnium is used in powdered boride form as the porous undercoat. Aluminum is optional and it is therefore evident that the coating does not rely on the formation of an alumina film for surface protection. U.S. Pat. No. 3,746,279 discloses a multilayer protective coating containing a large portion of manganese. In Table IV a coating composition containing hafnium is shown to be inferior to all other coating combinations tested. The coating described in this patent does not rely on alumina as a protective layer.

SUMMARY OF THE INVENTION

In this application, all compositions are given in weight percent unless otherwise specified. The coating composition of the present invention contains from 10–40 percent chromium, from 6–20 percent aluminum, from 0.5–3 percent hafnium with a balance selected from the group consisting of nickel and cobalt and mixtures thereof. The coating of the present invention may be applied by several different techniques including plasma spray techniques, sputtering, vapor deposition, and ion implantation techniques. Upon exposure to oxidation/corrosion inducing environment the coating forms a layer comprised predominately of alumina which serves to protect the coating material from further oxidation/corrosion.

The foregoing, and other objects, features and advantages of the present invention will become more apparent in the light of the following detailed description of the preferred embodiment thereof as shown in the accompanying drawings.

DESCRIPTION OF THE PREFERRED EMBODIMENTS

Figure 1:
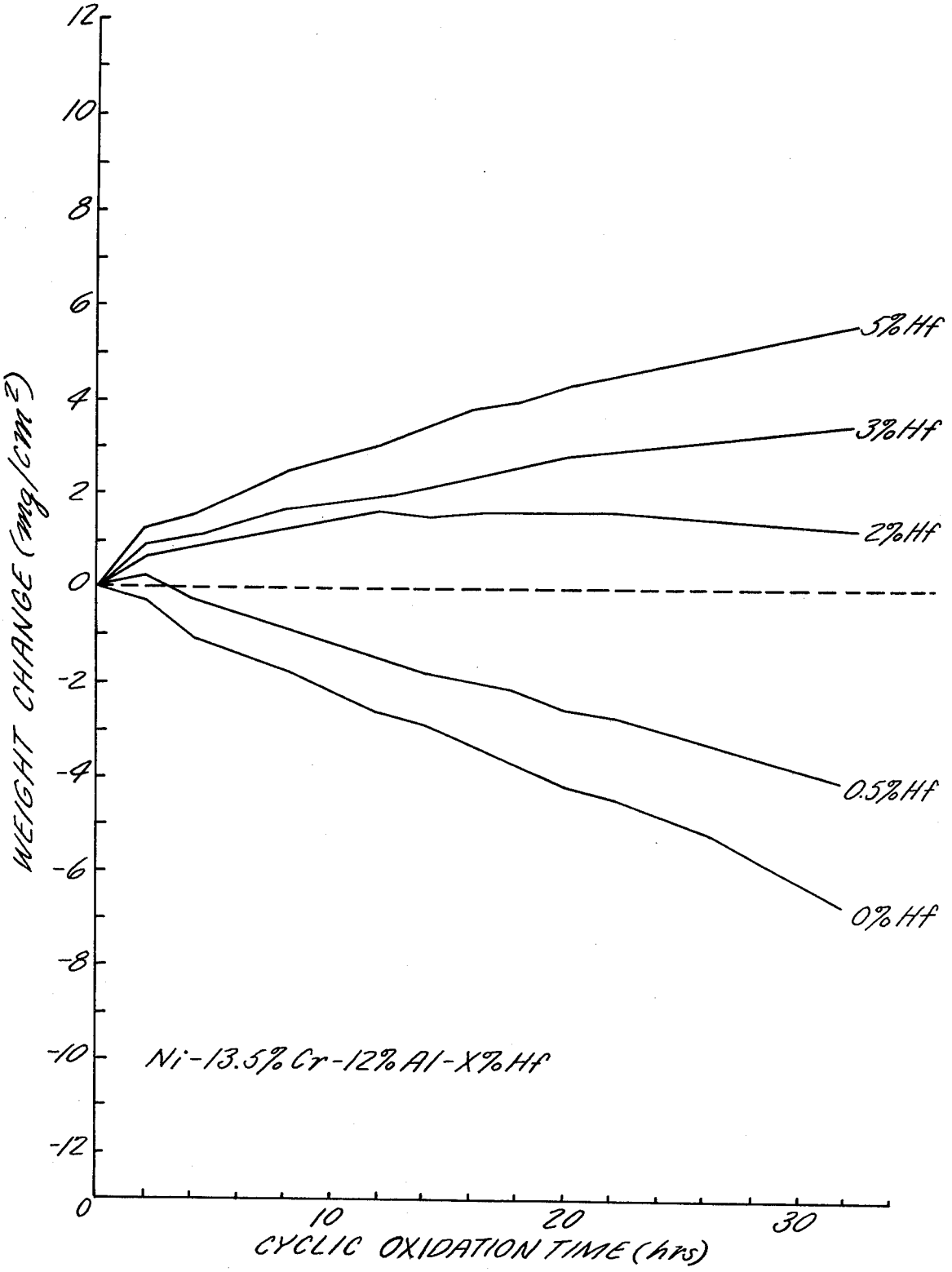
FIG. 1 shows the cyclic oxidation performance of a nickel base coating alloy according to the present invention containing different hafnium levels.

The advantages of the present coatings, which contain hafnium, over the prior art coatings which contain yttrium are related to the greater solubility of hafnium in nickel and cobalt alloys as compared with yttrium. The process by which additions of hafnium and yttrium improve the adherence of the protective alumina coating is believed to involve internal oxidation. Both hafnium and yttrium have a greater affinity for oxygen than aluminum and it is believed that the oxygen which diffuses into the coating forms internal hafnium oxide particles extending from the surface oxide layer into the coating material. Microscopic examination of oxidized parts appears to confirm this theory. These hafnium oxide particles are believed to anchor or peg the alumina layer to the coating material and to reduce spallation of the alumina surface layer during cyclic thermal exposures. Coatings of the type described are particularly useful in connection with gas turbine engine components, such as blades and vanes, made of nickel and cobalt superalloys which must operate at elevated temperatures.

The solid solubility of yttrium in nickel and cobalt base alloys is small, 0.02–0.05 percent while the solid solubility of hafnium in such alloys is much greater and can be as much as about 3 percent.

In the concept of the invention, which utilizes the addition of small controlled amounts of hafnium to coatings to promote alumina adherence, may be applied to several coating compositions. In particular, coatings based on cobalt, nickel, and mixtures of cobalt and nickel are preferred. The broad limits on the remaining constituents are from about 10 to about 45 percent chromium, from about 6 to about 25 percent aluminum and from about 0.5 to about 3 percent hafnium.

The coatings of the present inventions have many potential uses, among these are gas turbine parts, furnace components, and industrial chemical processing apparatus. The broad range of coatings of this invention is particularly adapted for use in protecting the superalloy components which are used in gas turbine engines, such as blades and vanes. Superalloys are those alloys, usually based on nickel or cobalt which possess relatively high strengths at elevated temperatures. A particularly preferred composition range of the present invention consists of from about 10 to about 35 percent chromium, from about 10 to about 20 percent aluminum, from about 0.5 to about 3.0 percent hafnium, balance chosen from the group consisting of nickel, cobalt and mixtures thereof. When the coating is used in gas turbine applications the preferred coating thickness will be from about 0.001 to about 0.010 inches. In the compositions set forth above, the hafnium is present in elemental form as a solid solution. The preceding composition limits are illustrative of the invention and naturally small amounts of other elements may be added in amounts which do not affect the fundamental nature and behavior of the coating layer.

Within the preceding composition ranges, certain preferred ranges may be experimentally determined. As previously described, two important types of oxides form in service, a continuous protective surface layer of alumina and discrete internal hafnium oxide particles. While the alumina is a good diffusion barrier, certain elements, such as oxygen appear to diffuse rapidly through hafnium oxide. Accordingly the composition should be selected so as to control the depth of the hafnium oxide particles. Particularly protective coatings result when the hafnium oxide particles extend into the coating to a depth of about three times the thickness of the alumina layer.

The present invention will be better understood through reference to the following illustrative examples.

EXAMPLE 1

An alloy containing 13.5 percent chromium, 12 percent aluminum, balance nickel was prepared along with samples of an identical alloy containing 0.5, 2, 3 and 5 percent hafnium. These alloys were tested under cyclic oxidation conditions at 1200° C in air for varying periods. The duration of the cycles was two hours with intervening cooling to room temperatures.

In this type of test, the oxidation behavior of the coating is evaluated by measuring the change in weight of the sample. Two processes occur and cause the weight change: formation of an oxide layer leads to an increase, while spallation of the oxide leads to a decrease. The processes of formation and spallation are competitive in the sense that the actual change in weight reflects the combined effects of the two processes. The most desirable situation is the formation of a thin adherent oxide layer which then increases at a rate inversely proportional to its thickness. Thus in evaluating oxidation data in the form of weight change curves, the desirable curve would show an initial small increase followed by a steady state portion with only a minimal weight increase, (optical evaluation of the samples should be performed to investigate possible spallation). The results are shown in FIG. 1 which shows that increasing hafnium levels improved the adherence of the oxide layer and that a level somewhere in excess of 0.5 percent must be used to adequately inhibit spallation. Levels of 3 percent and above lead to increased amounts of oxide formation. Optical evaluation showed that spallation was very minimal for alloys with hafnium contents of 0.5 to 3 percent.

EXAMPLE 2

Figure 2:
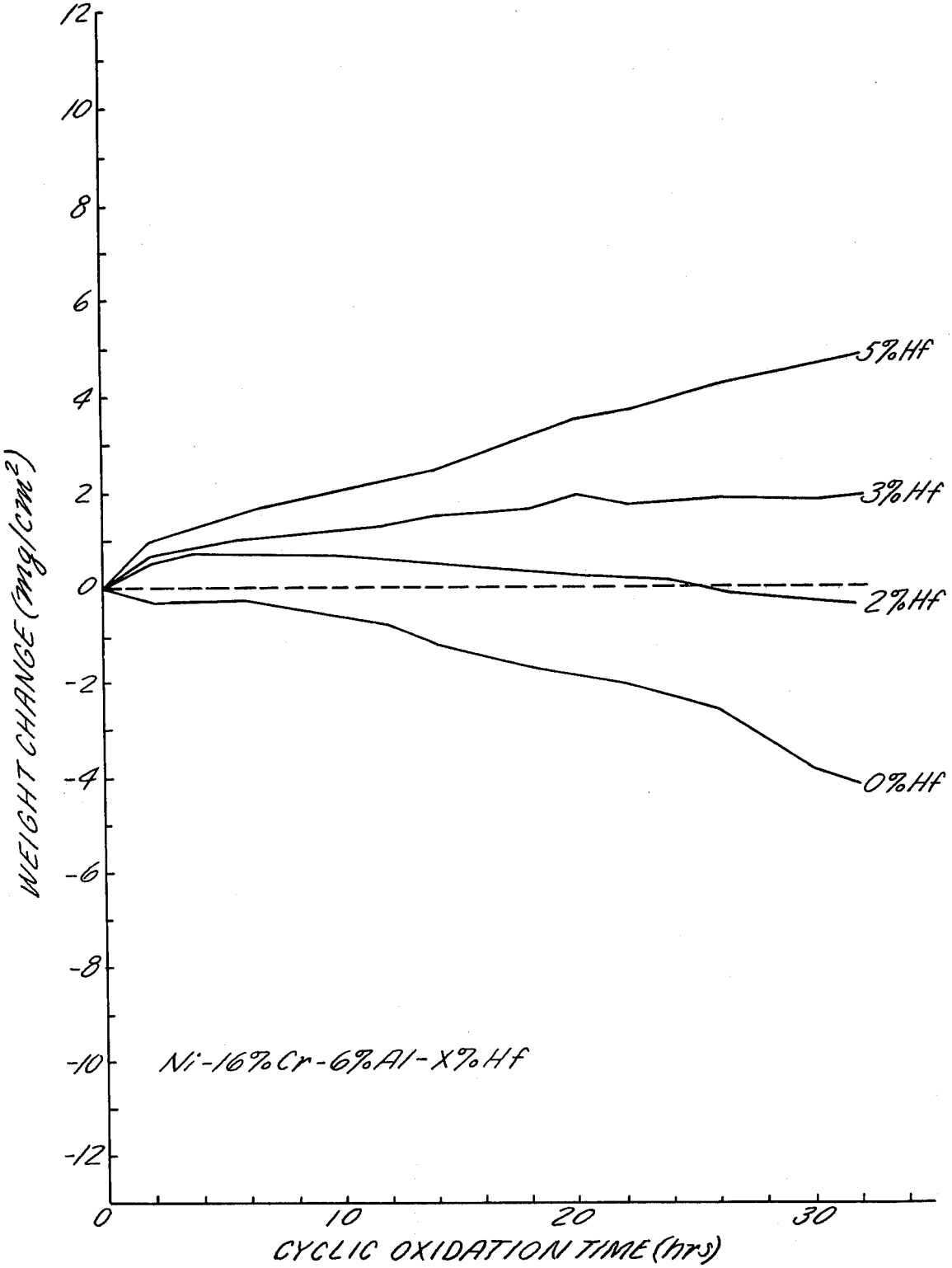
FIG. 2 shows the cyclic oxidation performance of nickel base coating alloys according to the present invention containing different hafnium levels.
Figure 4:
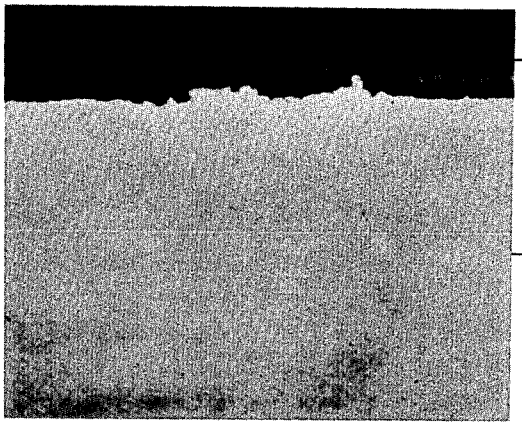
FIG. 4 shows a typical microstructure of a hafnium free alloy similar to that shown in FIG. 3 after cyclic oxidation.
Figure 3:
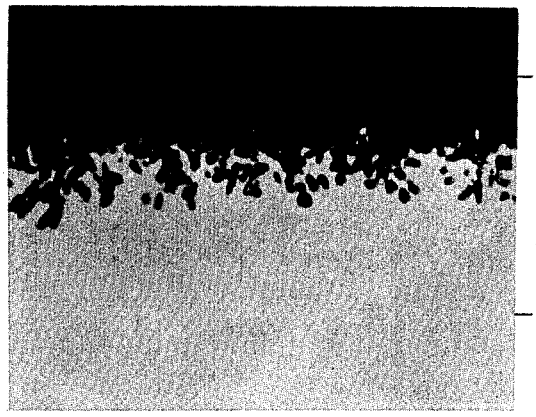
FIG. 3 shows a typical microstructure of an alloy containing 15 percent chromium, 6 percent aluminum, 3 percent hafnium, balance nickel, after cyclic oxidation.

A series of alloys containing 16 percent chromium, 6 percent aluminum, balance nickel was prepared with hafnium levels of 0, 2, 3 and 5 percent. These samples were tested under cyclic oxidation conditions as described in example 1 and the results are shown in FIG. 2. Referring to FIG. 2 it can be seen that for the particular base alloy composition used the optimum hafnium content appears to lie in the range of 2–3 percent. Spallation was observed to be minor for these alloys. FIG. 3 shows the typical microstructures of the alloy of the present example containing 3 percent hafnium after cyclic oxidation of 32 hours at 1200° C in air at atmospheric pressure. The internal hafnium oxide particles are clearly visible and extend into the substrate material for several microns. FIG. 4 shows a comparative microstructure of an alloy containing 0 percent hafnium. Repeated cracking and spallation followed by subsequent $Al_2O_3$ formation is evident here but the degradation has not been operative long enough to form other faster growing oxides than alumina.

EXAMPLE 3

Figure 5:
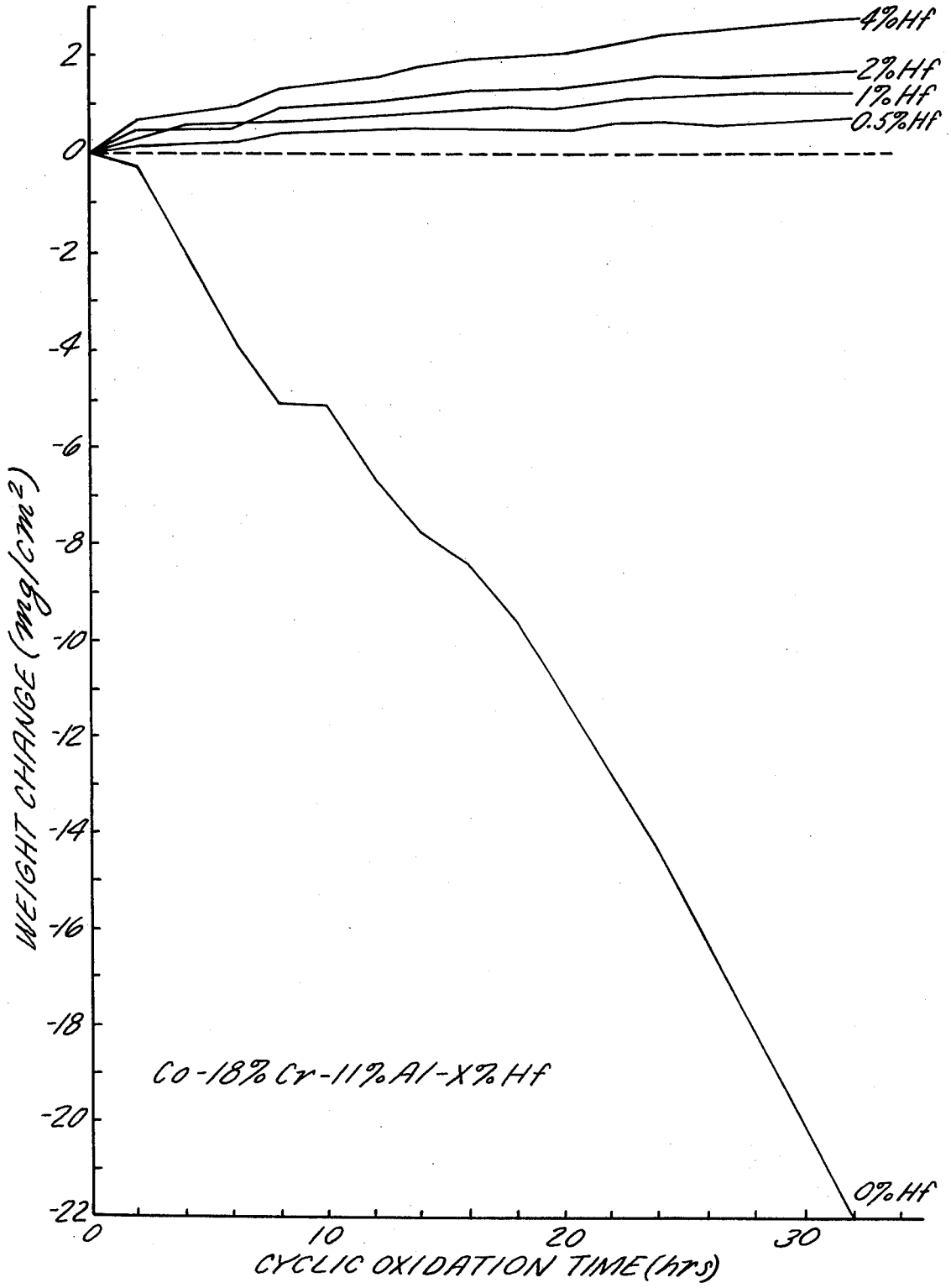
FIG. 5 shows the cyclic oxidation performance of cobalt base coating alloys according to the present invention containing differing hafnium levels.

A series of alloys containing 18 percent chromium, 11 percent aluminum, balance cobalt were prepared with levels of 0.5, 1, 2 and 4 percent hafnium. These samples were tested under cyclic oxidation conditions as described in example 1 and the results are shown in FIG. 5. It can be seen in FIG. 5 that optimum hafnium levels for this particular alloy composition lie in the range of from 0.5 to about 2 percent hafnium. Metallographic examination confirmed that these alloys underwent only slight spallation. FIG. 5 shows the significant improvement in oxide adherence which can result from the addition of only a small percentage of hafnium. An alloy containing 0.5 percent hafnium had a weight gain of 0.7 $mg/cm^2$ after 32 hours while an alloy containing no hafnium had a weight loss of about 22 $mg/cm^2$.

Although the invention has been shown and described with respect to preferred embodiments thereof, it should be understood by those skilled in the art that various changes and omissions in the form and detail thereof may be made therein without departing from the spirit and the scope of the invention.

We claim:

1. A method of protecting superalloy articles from oxidation/corrosion at elevated temperatures which comprises:

applying a layer of material to the surface of the article, said material having a thickness of from 0.001 to 0.010 inches and consisting essentially of from about 10 to about 45 percent chromium, from about 6 to about 25 percent aluminum, from about 0.5 to about 3 percent hafnium, balance chosen from the group consisting of nickel, cobalt, and mixtures thereof.

2. A method as in claim 1 wherein the material contains from about 10 to about 35% Cr.

3. A method as in claim 1 wherein the material contains from about 10 to about 20% Al.

* * * * *